US011396771B2

(12) United States Patent
Jung et al.

(10) Patent No.: US 11,396,771 B2
(45) Date of Patent: Jul. 26, 2022

(54) GASKET FOR REFRIGERATOR DOOR

(71) Applicant: Samsung Electronics Co., Ltd., Suwon-si (KR)

(72) Inventors: Mingyu Jung, Suwon-si (KR); Kookjeong Seo, Suwon-si (KR); Jimin Hong, Suwon-si (KR); Jungsoo Lim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/155,691

(22) Filed: Jan. 22, 2021

(65) Prior Publication Data

US 2021/0222483 A1 Jul. 22, 2021

(30) Foreign Application Priority Data

Jan. 22, 2020 (KR) ..... 10-2020-0008525
Nov. 3, 2020 (KR) ..... 10-2020-0144906

(51) Int. Cl.
*E06B 7/16* (2006.01)
*F25D 23/02* (2006.01)
*F25D 23/08* (2006.01)

(52) U.S. Cl.
CPC ..... *E06B 7/16* (2013.01); *F25D 23/028* (2013.01); *F25D 23/085* (2013.01); *F25D 23/087* (2013.01); *E05Y 2800/12* (2013.01); *F25D 2201/126* (2013.01)

(58) Field of Classification Search
CPC ..... F25D 23/087; F25D 23/028; F25D 2201/126; E06B 7/16
See application file for complete search history.

(56) References Cited

U.S. PATENT DOCUMENTS 6,231,799 B1 * 5/2001 Kempf ..... B29C 43/003 264/319
9,290,685 B2 3/2016 Lee
2006/0188690 A1 * 8/2006 Jun ..... F25D 23/087 428/99

FOREIGN PATENT DOCUMENTS

CN 102702647 A 10/2012
CN 105086299 A 11/2015
CN 106916468 A 7/2017
CN 107044758 A 8/2017
JP 11-304351 A 11/1999
JP 6510906 B2 5/2019
(Continued)

OTHER PUBLICATIONS

English translation of JP2019108913A from espacnet (Year: 2021).*
International Search Report dated Apr. 29, 2021, issued in International Patent Application No. PCT/KR2021/000496.

*Primary Examiner* — Daniel J Rohrhoff
(74) *Attorney, Agent, or Firm* — Jefferson IP Law, LLP

(57) ABSTRACT

A gasket for a refrigerator door is provided. The gasket includes a body configured to be arranged between a main body of a refrigerator and a refrigerator door, and a magnet inserted to the body and arranged to be attached to or detached from the main body of the refrigerator. The body includes, by weight % (wt %), about 30 to 60% of thermoplastic resin, about 20 to 40% of plasticizer, about 3 to 30% of filler, and one or more other additives. The filler is provided with one or more hollow particles or a porous material having a diameter of about 1 to 100 μm, the filler having a heat conductivity of about 0.0001 to 0.2 W/m·K.

21 Claims, 6 Drawing Sheets

(56) References Cited

FOREIGN PATENT DOCUMENTS

| | | | | |
|---|---|---|---|---|
| JP | 2019-108913 | A | 7/2019 | |
| KR | 10-0452391 | B1 | 4/2005 | |
| KR | 10-0484121 | B1 | 4/2005 | |
| KR | 10-1106635 | B1 | 1/2012 | |
| KR | 10-2016-0094662 | A | 8/2016 | |
| WO | WO-2004033974 | A1 * | 4/2004 | ..... C09K 3/10 |
| WO | WO-2015033754 | A1 * | 3/2015 | ..... F25D 23/02 |

* cited by examiner

GASKET FOR REFRIGERATOR DOOR

CROSS-REFERENCE TO RELATED APPLICATION(S)

This application is based on and claims priority under 35 U. S. C. § 119(a) of a Korean patent application number 10-2020-0008525 filed on Jan. 22, 2020, in the Korean Intellectual Property Office and of a Korean patent application number 10-2020-0144906 filed on Nov. 3, 2020, in the Korean Intellectual Property Office, the disclosure of each of which is incorporated by reference herein in its entirety.

BACKGROUND

1. Field

The disclosure relates to a gasket for refrigerator door. More particularly, the disclosure relates to a gasket for refrigerator door with enhanced insulation performance.

2. Description of Related Art

Refrigerators are home appliances having a main body with storerooms and a cold air supply system for supplying cold air into the storerooms, to keep food and groceries fresh. The storerooms include a fridge maintained at temperatures of about 0 to 5 degrees Celsius for keeping groceries cool, and a freezer maintained at temperatures of about 0 to −30 degrees Celsius for keeping groceries frozen. The storeroom commonly has an open front through which to take out or receive food, and the open front is opened or closed by a door.

The refrigerator keeps the storeroom at low temperatures in the following method. First, a compressor suctions in and compresses a refrigerant gas. The refrigerant gas whose temperature rises as the refrigerant gas is compressed is cooled down and liquefied while passing a condenser. The liquefied refrigerant is jetted into an evaporator to be evaporated, cooling the storeroom by absorbing heat in the storeroom for evaporation heat. The evaporated refrigerant gas is suctioned back into the compressor, cooling the inside of the storeroom through the aforementioned series of processes.

When the temperature in the storeroom of the refrigerator rises, the compressor and the condenser are operated to keep the storeroom at a low temperature. The rate of operation of the compressor and condenser directly contributes to power consumption of the refrigerator, so it is important to reduce the rate of operation of the compressor and condenser by minimizing the temperature rise in the storeroom to reduce the power consumption.

FIG. 1 shows factors that may cause temperature rise in the storeroom of a typical refrigerator and percentages of energy consumed for the respective factors to keep the storeroom at a low temperature according to the related art.

Referring to FIG. 1, energy consumption for the refrigerator's wall insulation is 52%, energy consumption for a door gasket is 30%, energy consumption for a defrost heater is 6%, energy consumption for a fan motor is 6%, and energy consumption for an external heater is 6%.

Recently, studies are being conducted to reduce energy consumption related to the refrigerator's wall insulation by using a highly-insulating composite substance such as polyurethane foam, a vacuum insulation panel (VIP), etc., to preserve cold air and reduce power consumption. For the door gasket highly contributing to energy consumption, however, there is a lack of study to increase the insulation performance thereof.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure provides a gasket for refrigerator door with enhanced insulation performance.

Additional aspects will be set forth in part in the description which follows and, in part, will be apparent from the description, or may be learned by practice of the presented embodiments.

In accordance with an aspect of the disclosure, a gasket for a refrigerator door is provided. The gasket includes, by weight % (wt %), about 30 to 60% of thermoplastic resin, about 20 to 40% of plasticizer, about 3 to 30% of filler, and about 0.5 to 5% of surface modification agent. The filler is provided with one or more hollow particles or a porous material having a diameter of about 1 to 100, the filler having a heat conductivity of about 0.0001 to 0.2 Watts per meter-Kelvin (W/m·K). The surface modification agent has a molar mass of about 100 to 500 g/mol.

The filler may have a pressure intensity of about 500 to 20,000 PSI.

Air holes of the one or more hollow particles or of the porous material may be filled with an insulation material having a heat conductivity of about 0.03 W/m·K or less.

The thermoplastic resin may include, by wt %, about 15 to 30% of polyvinyl chloride, and about 15 to 30% of elastomer.

The elastomer may include at least one of a styrene-butadiene rubber, a chloroprene rubber, silicon, thermoplastic polyurethane, thermoplastic vulcanizate, thermoplastic polyolefin or thermoplastic styrene.

In accordance with another aspect of the disclosure, a gasket for a refrigerator door is provided. The gasket includes, by weight % (wt %), about 30 to 60% of thermoplastic resin, about 20 to 40% of plasticizer, and about 3 to 30% of filler, wherein the filler is provided with one or more hollow particles having a diameter of about 1 to 100 μm or a porous material, the filler having a heat conductivity of about 0.0001 to 0.2 W/m·K. The thermoplastic resin comprises, by wt %, about 15 to 30% of polyvinyl chloride, and about 15 to 30% of elastomer.

The elastomer may include at least one of a styrene-butadiene rubber, a chloroprene rubber, silicon, thermoplastic polyurethane, thermoplastic vulcanizate, thermoplastic polyolefin or thermoplastic styrene.

The gasket may further include, by wt %, about 0.5 to 5% of surface modification agent.

The surface modification agent may have a molar mass of about 100 to 500 g/mol.

The filler may have a pressure intensity of about 500 to 20,000 PSI.

Air holes of the one or more hollow particles or of the porous material may be filled with an insulation material having a heat conductivity of about 0.03 W/m·K or less.

In accordance with another aspect of the disclosure, a gasket for a refrigerator door is provided. The gasket includes a body configured to be arranged between a main body of a refrigerator and a refrigerator door, and a magnet inserted to the body and arranged to be attached to or detached from the main body of the refrigerator. The body includes, by weight % (wt %), about 30 to 60% of thermoplastic resin, about 20 to 40% of plasticizer, about 3 to 30% of filler, and one or more additional additives. The filler is provided with one or more hollow particles or a porous material having a diameter of about 1 to 100 μm, the filler having a heat conductivity of about 0.0001 to 0.2 W/m·K.

Air holes of the one or more hollow particles or of the porous material may be filled with an insulation material having a heat conductivity of about 0.03 W/m·K or less.

The insulation material may be filled at a filling ratio of about 10 to 60%.

The air holes of the one or more hollow particles or the porous material may be provided in a vacuum state.

The porous material may have an air hole ratio of about 10 to 60%.

The thermoplastic resin may include one or more of polyvinyl chloride, polyethylene, polypropylene, thermoplastic elastomer, thermoplastic vulcanizate, and thermoplastic polyolefin.

The plasticizer may include one or more of dioctyl phthalate, dioctyl adipate, diisodecyl phthalate, and trioctyl trimellitate.

The body may have extrusion molding temperature of about 140 to 200° C.

The body may have 0.5 kgf/mm2 or more of tensile strength, about 150% or more of extension rate, and about 60 to 70 Hs of hardness.

The body may have a heat conductivity of about 0.2 W/m·K or less.

The magnet may include about 40 to 89.5% of ferrite powder, about 10 to 40% of thermoplastic resin, and about 0.5 to 20% of filler.

According to another aspect of the disclosure, a gasket for a refrigerator door includes a body configured to be arranged between a main body of a refrigerator and a refrigerator door, and a magnet inserted to the body and arranged to be attached to or detached from the main body of the refrigerator. The magnet includes, by weight % (wt %), 40 to 89.5% of ferrite powder, about 10 to 40% of thermoplastic resin, and about 0.5 to 20% of filler. The filler is provided with one or more hollow particles or a porous material having a diameter of about 1 to 100 μm, the filler having a heat conductivity of about 0.0001 to 0.2 W/m·K.

Air holes of the one or more hollow particles or of the porous material may be filled with an insulation material having a heat conductivity of about 0.03 W/m·K or less.

The insulation material may fill in at a filling ratio of about 10 to 60%.

The air holes of the one or more hollow particles or the porous material may be provided in a vacuum state.

The porous material may have an air hole ratio of about 10 to 60%.

The ferrite powder may include one or more of strontium ferrite oxide powder, barium ferrite oxide powder, and rare earth powder.

The thermoplastic resin may include one or more of polyethylene, polypropylene, polyvinyl chloride, acrylonitrile-butadien-styrene, polyamide, and chlorinated polyethylene.

The magnet may have a heat conductivity of about 1 W/m·K or less and have magnetic power (or magnetic force) of about 70 g/50 mm.

According to another aspect of the disclosure, a refrigerator may include a main body defining a storeroom, a door arranged to open or close the storeroom, and the aforementioned gasket arranged between the main body and the door.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features and advantages of certain embodiments of the disclosure will be more apparent from the following description taken in conjunction with the accompanying drawings, in which.

The same reference numerals are used to represent the same elements throughout the drawings

DETAILED DESCRIPTION

Figure 1:
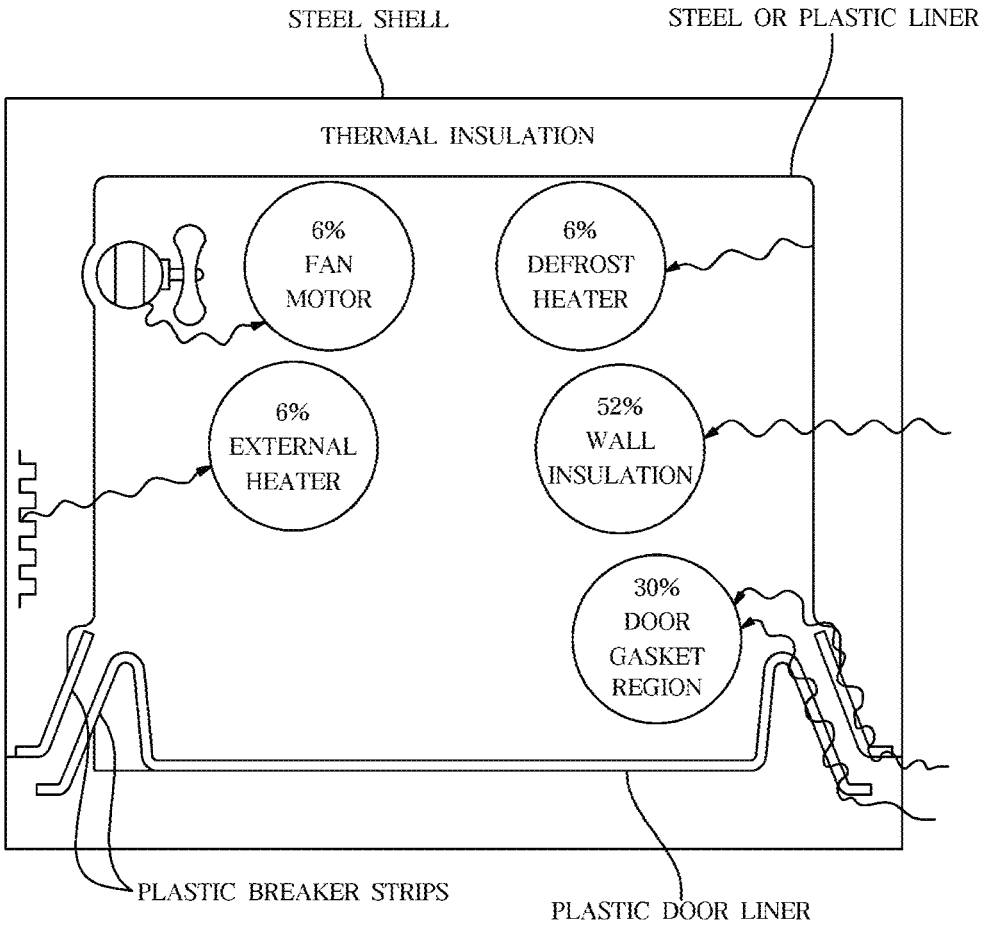
FIG. 1 shows factors that cause temperature rise in a storeroom of a refrigerator and percentages of energy consumed for the respective factors to keep the storeroom at a low temperature according to the related art.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Terms as herein used are just for illustration. For example, the singular expressions include plural expressions unless the context clearly dictates otherwise. It will be further understood that the terms "comprises" and/or "comprising," when used in this specification, specify the presence of stated features, integers, operations, elements, and/or components, but do not preclude the presence or addition of one or more other features, integers, operations, elements, components, and/or groups thereof.

Unless otherwise defined, all terms used herein have the same meaning as commonly understood by those of ordinary skill in the art to which the disclosure belongs. Furthermore, unless otherwise clearly defined, a specific term should not be construed as having overly ideal or formal meaning. It is to be understood that the singular expression include plural expressions unless the context clearly dictates otherwise.

Throughout the specification, the word 'about', 'substantially' or the like, is used to indicate that a numerical value used with the word belongs to a range around the numerical value, to prevent an unscrupulous pirate from unduly making an advantage of a description in which the absolute numerical value is mentioned.

A structure and operating principle of a gasket according to an embodiment of the disclosure when a door is opened or closed will now be described first. The gasket structure and reference numerals are just provided to help to understand the disclosure, without being limited thereto.

Figure 2:
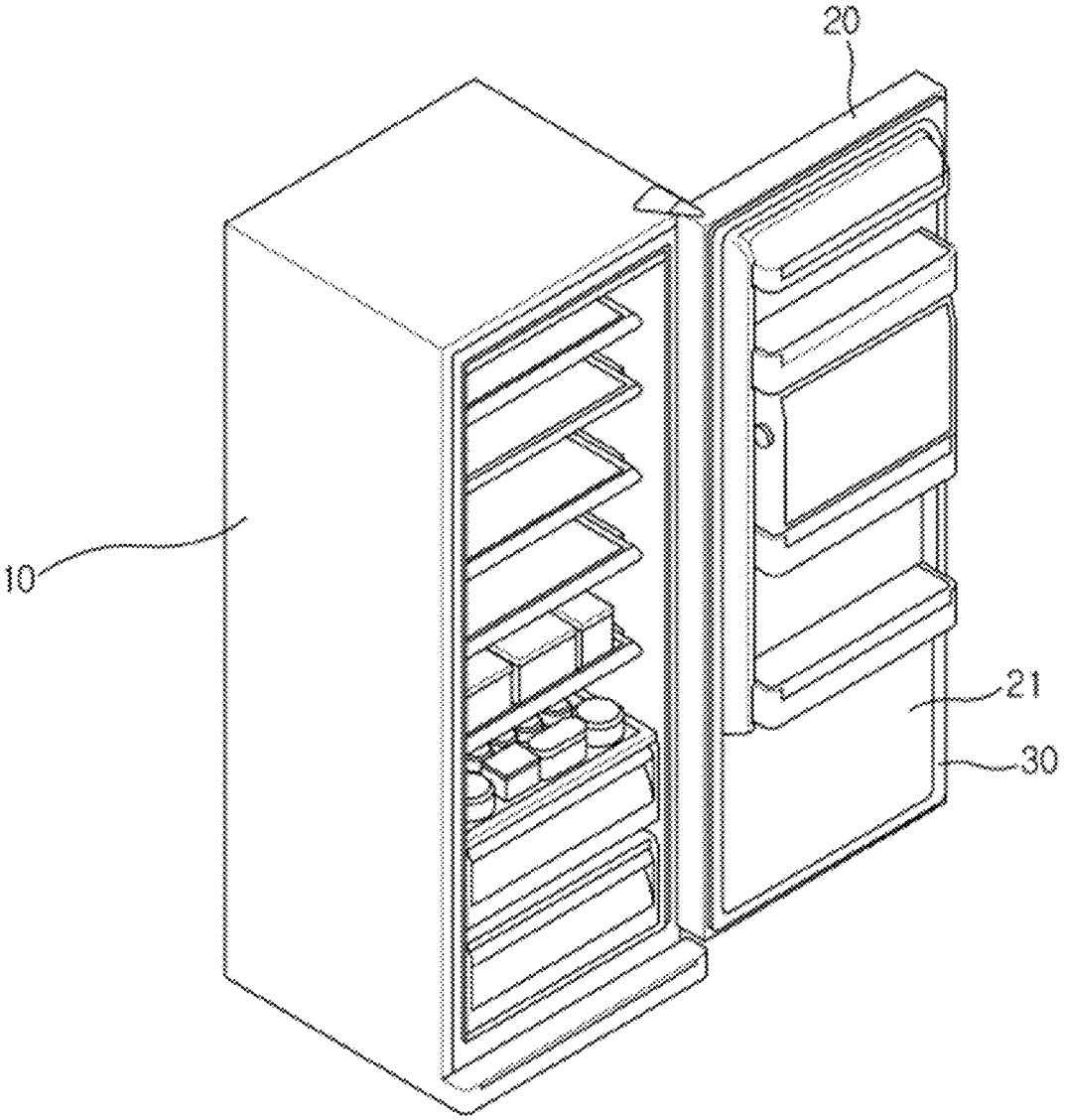
FIG. 2 is a perspective view of an open refrigerator according to an embodiment of the disclosure.

FIG. 2 is a perspective view of an open refrigerator according to an embodiment of the disclosure.

Referring to FIG. 2, a gasket 30 is arranged between a door 20 and a main body 10 of a refrigerator for preventing cold air supplied into a storeroom from leaking out.

Figure 3:
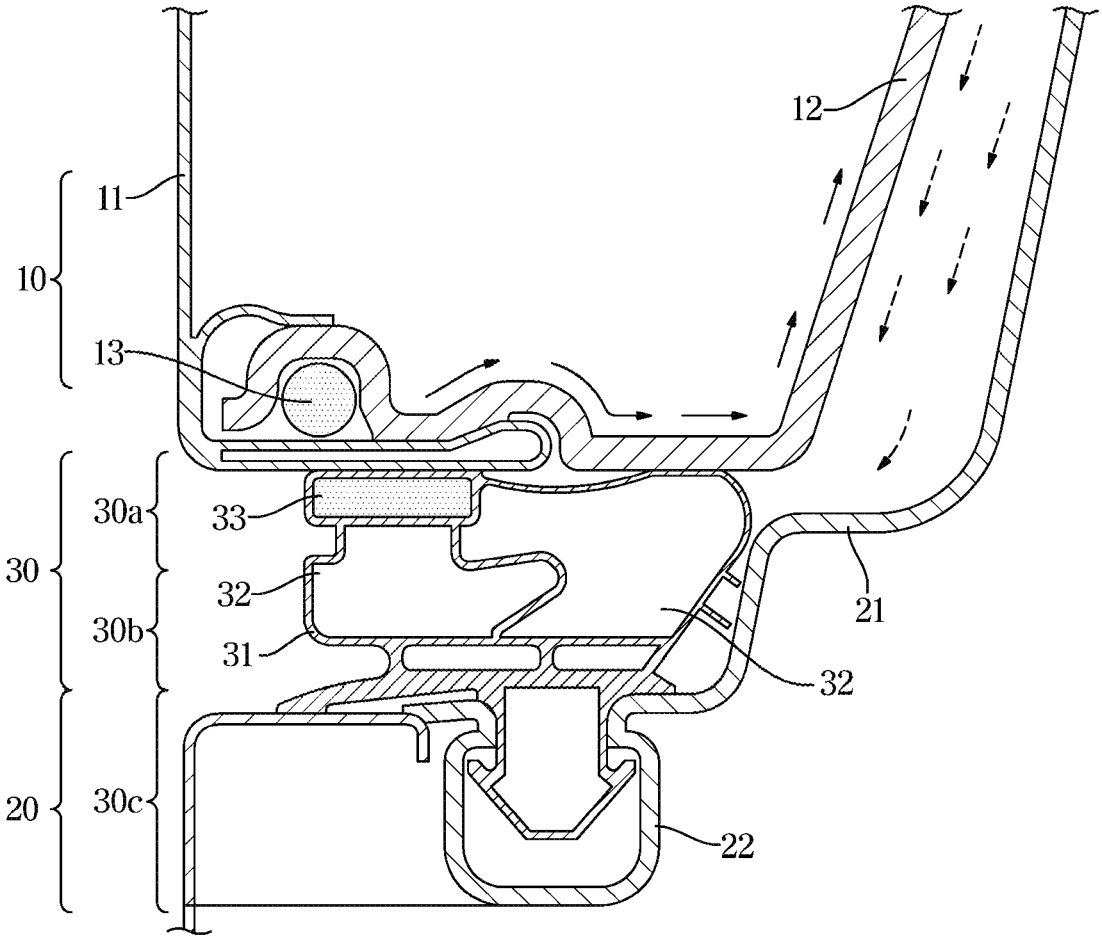
FIG. 3 is a cross-sectional view of a refrigerator with a door, a main body, and a gasket according to an embodiment of the disclosure.

FIG. 3 is a cross-sectional view of a refrigerator with a door, a main body, and a gasket according to an embodiment of the disclosure.

Referring to FIG. 3, the gasket 30 may include an airtight contact portion 30*a* closely contacting the front side of the main body 10 of the refrigerator due to magnetic force of a magnet 33 inserted to the body 31 for the door 20 to seal the refrigerator, a connecting portion 30*b* integrally formed with the bottom of the airtight contact portion 30*a* and partitioned by a partition wall to define certain space under the airtight contact portion 30*a*, a coupling portion 30*c* integrally formed with the bottom of the connecting portion 30*b*, and shaped like an anchor inserted and fixed to a coupling groove 22 of a door liner 21 of the refrigerator door 20 so that the airtight contact portion 30*a* and the connecting portion 30*b* may be fixed to the door liner 21. Air pockets 32 provided by being separated with the partition wall in the connecting portion 30*b* serve to absorb shocks during contact between the refrigerator door 20 and the main body 10 of the refrigerator.

When the refrigerator door 20 equipped with the gasket 30 fixed thereto is closed on the front side of the main body 10 to seal the main body 10, the magnet 33 inserted to the airtight contact portion 30*a* of the gasket 30 is stuck to an outer case 11 on the outside of the refrigerator formed with a magnetic body, making the inside of the refrigerator completely shielded from the outside. When the door 20 is pulled to separate the door 20 from the main body 10, a tensile load for the door liner 21 of the door 20 to pull the coupling portion 30*c* of the gasket 30 is applied. The tensile load conveyed to the coupling portion 30*c* causes the connecting portion 30*b* integrally formed with the coupling portion 30*c* to be pulled out, making the airtight contact portion 30*a* with the magnet 33 inserted thereto pulled out as well. As a result, the airtight contact portion 30*a* stuck to the front side of the main body 10 of the refrigerator by the magnetic force is separated from the outer case 11 of the main body 10 of the refrigerator, and the main body 10 is opened.

The gasket 30 used for the refrigerator door 20 has various requirements by nature, and the most important of the requirements is, as described above, insulation performance that maintains air tightness between the door 20 and the main body 10 to prevent cold air from leaking out from the inside of the refrigerator and prevent heat transfer from the outside to the inside of the refrigerator.

Referring to FIG. 3, solid arrows represent a heat conduction path along which heat from a hot line 13 moves through an inner case 12 and dotted arrows represent a cold air loss path between the inner case 12 and the door liner 21. The body 31 of the gasket 30 used for a conventional refrigerator has heat conductivity greater than 0.2 W/m·K, so the heat transfer is made from the outside to the inside as indicated by the solid arrows of FIG. 3 or the cold air of the inside is lost as indicated by the dotted arrows of FIG. 3, thereby consuming energy of the refrigerator according to the related art.

Hence, the disclosure proposes a gasket for refrigerator door with enhanced insulation performance in particular to reduce power consumption of the refrigerator by controlling composition of a gasket body and composition of a magnet inserted to the gasket.

In a first embodiment of the disclosure, a gasket for refrigerator door may include a body arranged between the refrigerator door and the main body of the refrigerator, and a magnet inserted to the body to be attached to or detached from the refrigerator body. The body represented by weight % (wt %) includes a thermoplastic resin: about 30 to 60%, a plasticizer: about 20 to 40%, a filler: about 3 to 30%, and the other additives. The additives may include one or more of a stabilizer, a lubricant, a reinforcing agent, an antimicrobial agent, and a pigment.

The reason of limiting the body composition of the gasket for refrigerator door will now be described in detail.

A Thermoplastic Resin: About 30 to 60 wt %

When the refrigerator door is opened or closed, the gasket for refrigerator door receives a constant stress by bending and extending itself. Hence, the body of the gasket for refrigerator door needs to have sufficient strength as well as softness to secure durability. Furthermore, the body of the gasket needs to have sufficient profile extrusion performance to be manufactured into a complicated shape for forming air pockets that absorb shocks, having a structure to have a magnet inserted thereto, opening or closing the door smoothly, etc.

In the disclosure, the thermoplastic resin is a soft material suitable for profile extrusion, and actively added to secure physical properties such as tensile strength, extension rate, and hardness of the gasket body. When the thermoplastic resin content is less than about 30 wt %, it makes profile extrusion difficult, and leads to insufficient durability. On the other hand, when the thermoplastic resin content is greater than about 60 wt %, insulation performance declines. Hence, in the disclosure, about 30 to 60 wt % of thermoplastic resin may be added.

In the disclosure, the thermoplastic resin may have any composition as long as the composition makes the gasket body have enough moldability, durability, and surface stickiness, without being limited to a particular composition.

The thermoplastic resin may include one or more of e.g., polyvinyl chloride (PVC), polyethylene (PE), polypropylene (PP), thermoplastic elastomer (TPE), thermoplastic vulcanizate (TPV), and thermoplastic polyolefin (TPO).

A Plasticizer: About 20 to 40 wt %

In the disclosure, the plasticizer causes plastic flow of the polymer thermoplastic resin, making the processes such as extrusion, compression molding, etc., easy to manufacture the gasket. Furthermore, in the disclosure, given that filler, which will be described later, is added to increase hardness of the gasket composition, the plasticizer is actively added to give workability.

When the added plasticizer content is less than about 20 wt %, it is difficult to secure suitable softness for profile extrusion. On the other hand, when the plasticizer content exceeds about 40 wt %, heat conductivity declines. Hence, in the disclosure, about 20 to 40 wt % of plasticizer may be added.

In the disclosure, the plasticizer may have any composition as long as the composition makes the thermoplastic resin have enough liquidity, without being limited to a particular composition.

In the disclosure, for example, the plasticizer may include one or more of dioctyl phthalate (DOP), dioctyl adipate (DOA), diisodecyl phthalate (DIDP), and trioctyl trimellitate (TOTM).

A Filler: About 3 to 30 wt %

In the disclosure, the filler is an important component that reduces heat conductivity of the gasket body for refrigerator door to improve insulation performance. The filler has heat conductivity of about 0.0001 to 0.2 W/m·K, which is lower than that of the plasticizer or the thermoplastic resin, so the insulation performance of the gasket body may be improved.

In the disclosure, about 3 wt % or more of the filler is added to reduce the heat conductivity. When the filler is, however, overly added, it is likely to deteriorate the mechanical properties such as tensile strength, extension rate, hardness, etc., of the gasket body, and thus the durability of the gasket body. Given this, an upper limit of the filler added to the gasket body may be limited to about 30 wt %.

An embodiment of the filler will now be described in detail.

In an embodiment of the disclosure, the filler may be provided with one or more hollow particles with a diameter of about 1 to 100 μm. The term 'hollow particle' refers to a particle having an outer portion that defines a closed air hole inside. The outer portion of the hollow particle may be formed of silica, without being limited thereto.

In the disclosure, to increase the insulation property of the hollow particle, an insulation material with low heat conductivity may fill in the air hole of the hollow particle. For example, an insulation material with a heat conductivity of about 0.03 W/m·K or less may fill in the air hole. To reduce the heat conductivity sufficiently, the insulation material may fill in the air hole at a filling ratio of about 10 to 60%. Throughout the specification, the term 'filling ratio' refers to a ratio of a volume of a filling material to the entire volume of the air hole, which is calculated in percentage. The higher the filling ratio, the better the insulating property, so a lower limit of the filling ratio may be about 20% or preferably, about 30%. However, in a case that the filling ratio is high, a mechanical property such as tensile strength is likely to decline, so an upper limit of the filling ratio may be desired to be about 50%.

Furthermore, to increase insulation property of the hollow particle, the air hole of the hollow particle may be in a vacuum state. In the disclosure, the vacuum state refers to a full or part vacuum state, and the vacuum level may be increased to reduce heat conductivity. Accordingly, in the part vacuum state, the vacuum level may be in a range from a high vacuum region i.e., of about $10^{-4}$ Torr to about $10^{-7}$ Torr, to an ultrahigh vacuum region i.e., of about $10^{-10}$ Torr or less.

In the meantime, when the insulation material is in a liquid or solid state, the other areas than the area filled with the insulation material may be processed into a vacuum state by using e.g., a vacuum pump. In this case, heat conductivity may be reduced while saving manufacturing costs as compared with increasing the vacuum level.

In another embodiment of the disclosure, the filler may be formed with a porous material. The term 'porous material' as herein used refers to a material including one or more closed air holes. For the porous material, for example, porous ceramic material may be used, without being limited thereto.

In the disclosure, to increase the insulation property of the porous material, an insulation material with low heat conductivity may fill in the air hole of the porous material. For example, an insulation material with a heat conductivity of about 0.03 W/m·K or less may fill in the air hole. To reduce the heat conductivity sufficiently, the insulation material may fill in the air hole at a filling ratio of about 10 to 60%. The higher the filling ratio, the better the insulating property, so a lower limit of the filling ratio may be about 20% or preferably, about 30%. However, in a case that the filling ratio is high, a mechanical property such as tensile strength is likely to decline, so an upper limit of the filling ratio may be desired to be about 50%.

Furthermore, to increase insulation property of the porous material, the air hole of the porous material may be in a vacuum state. In the disclosure, the vacuum state refers to a full or part vacuum state, and the vacuum level may be increased to reduce heat conductivity. Accordingly, in the part vacuum state, the vacuum level may be in a range from a high vacuum region i.e., of about $10^{-4}$ Torr to about $10^{-7}$ Torr, to an ultrahigh vacuum region i.e., of about $10^{-10}$ Torr or less.

In the meantime, when the insulation material is in a liquid or solid state, the other areas than the area filled with the insulation material may be processed into a vacuum state by using e.g., a vacuum pump. In this case, heat conductivity may be reduced while saving manufacturing costs as compared with increasing the vacuum level.

In the disclosure, the porous material may be filled with an insulation material, or may have lots of air holes to process the inside into a vacuum state. For example, an air hole ratio of the porous material may be about 10 to 60%. The term 'air hole ratio' as herein used refers to a percentage of a volume occupied with the air hole in a porous material to the entire volume of the porous material. The higher the air hole ratio, the better the insulating property, so a lower limit of the air hole ratio may be about 20% or preferably, about 30%. In a case, however, that the air hole ratio of the porous material is high, a mechanical property such as tensile strength is likely to decline, so an upper limit of the air hole ratio may be desired to be about 50%.

In the meantime, the gasket may be manufactured in a method of e.g., extrusion, compression molding, or the like, and in this manufacturing process, to keep the filler in the hollow state, the filler may be provided to have about 500 to 20,000 pound per square inch (PSI), and preferably, about 3,000 to 6,000 PSI.

Although the two embodiments of the disclosure about the filler are provided in the above, the technical idea of the disclosure is not limited thereto. The filler may be filled with any insulation material, and various materials having closed space that may be processed into a vacuum state may be used for the filler.

Figure 4:
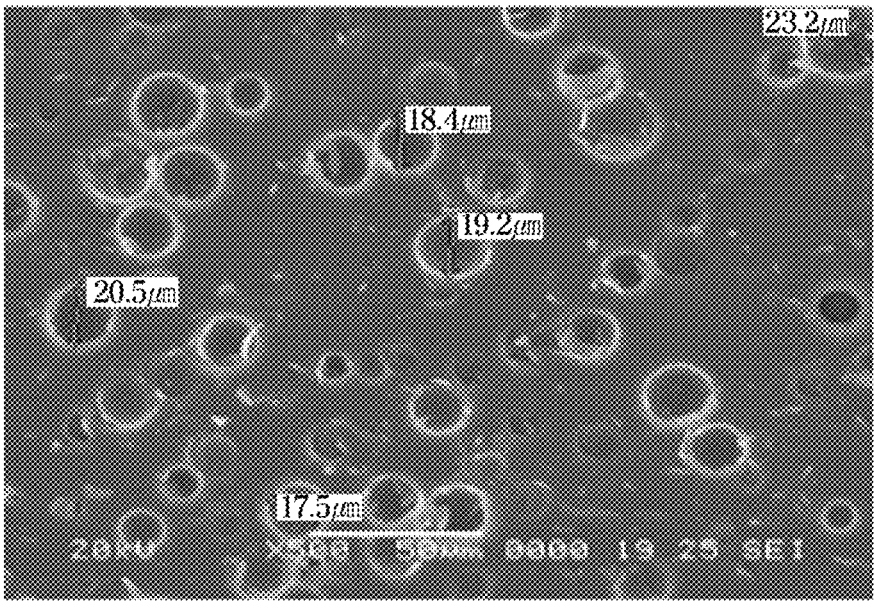
FIG. 4 is a picture of a gasket body of a refrigerator, according to an embodiment of the disclosure.

FIG. 4 is a picture of a gasket body of a refrigerator, according to an embodiment of the disclosure.

Referring to FIG. 4, the filler may be contained in composition of the gasket body. As described above, an insulation material with low heat conductivity may fill in the air hole of the filler, or the air hole may be controlled to be in a vacuum state to reduce the heat conductivity of the filler, so the higher the volume occupied with the filler in the entire composition, the lower the heat conductivity of the material.

In the disclosure, the gasket body for refrigerator door may include the other additives than the aforementioned composition. The additives may include one or more of a stabilizer, a lubricant, a reinforcing agent, an antimicrobial agent, and a pigment. The respective components will now be described.

The stabilizer is added to enhance stability of the gasket body for refrigerator door against heat, oxygen, ultraviolet (UV) rays, etc. For example, the stabilizer may be a heat-resistant stabilizer such as barium stearate, calcium stearate, epoxy soybean oil, etc., a cold-proof stabilizer such as a butylene laurate complex, a weather-proof stabilizer such as an organic phosphate ester-based complex, or the like.

The lubricant is added to enhance surface finish of an extrusion-molded gasket body and facilitate dispersion of a pigment. For example, the lubricant may be fatty alcohol, fatty acid, fatty acid amide, etc.

The reinforcing agent is added to improve mechanical strength, dimensional stability, thermal deformation temperature characteristics, hardness, and other physical properties. For example, the reinforcing agent may be a calcium carbonate based reinforcing agent.

The antimicrobial agent is added to prevent generation of a fungus or germs due to migration of the plasticizer.

The pigment is added to gain desired color on the gasket body. For example, the pigment may be a titanium oxide, carbon black, violet, etc.

The gasket body for refrigerator door having the aforementioned composition has better insulation performance with a heat conductivity of about 0.2 W/m·K or less by including the filler. Accordingly, cold air loss from the gasket may be reduced, and thus energy efficiency of the refrigerator may be improved.

Furthermore, in the disclosure, extrusion molding temperature of the gasket body for refrigerator door may be e.g., about 140 to 200° C. In the disclosure, as the gasket body for refrigerator door includes the filler, the extrusion molding temperature rises. When extrusion is performed at an ordinary extrusion molding temperature, e.g., about 110 to 130° C., of the gasket body for refrigerator door, surface roughness increases, making it more likely that molding quality decreases.

Figure 5A:
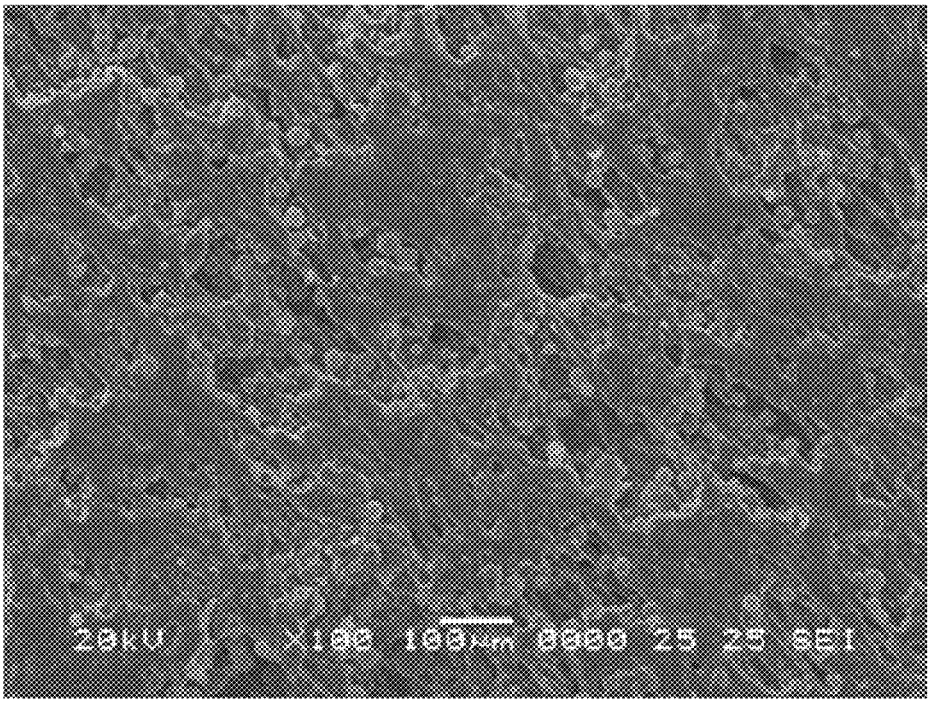
FIG. 5A is a surface picture of a gasket body for refrigerator door, which is extrusion molded at extrusion molding temperature of about 110 to 130 degrees Celsius, according to an embodiment of the disclosure.
Figure 5B:
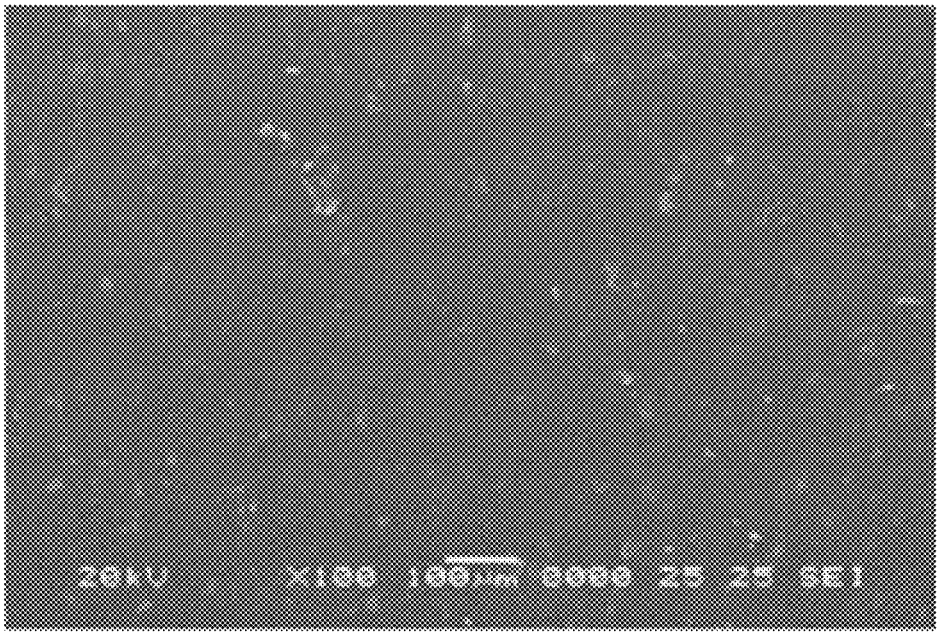
FIG. 5B is a surface picture of a gasket body for refrigerator door, which is extrusion molded at extrusion molding temperature of about 140 to 200 degrees Celsius, according to an embodiment of the disclosure.

FIGS. 5A and 5B are surface pictures of a gasket body for refrigerator door, which are extrusion-molded at extrusion molding temperatures of about 110 to 130° C. and about 140 to 200° C., respectively.

Comparing FIG. 5A with FIG. 5B, it is seen that the extrusion molding at the extrusion molding temperature of about 140 to 200° C. is more desirable in terms of the surface quality.

In the aforementioned embodiment of the disclosure, the gasket body for refrigerator door has about 0.5 kgf/mm$^2$ or more of tensile strength, about 150% or more of extension rate, and about 60 to 70 Hs of hardness.

In a second embodiment of the disclosure, a gasket for refrigerator door may include a body arranged between the refrigerator door and the refrigerator body, and a magnet inserted to the body to be attached/detached to/from the refrigerator body. The magnet represented by wt % includes ferrite powder: about 40 to 89.5%, a thermoplastic resin: about 10 to 40%, and filler: about 0.5 to 20%. For example, the magnet may further include a binder and a pigment.

How the magnet is inserted to the gasket body is not limited to a particular form as long as the magnet is inserted to the gasket body to be attached or detached by magnetic force to or from the outer case of the main body of the refrigerator formed with a magnetic substance. For example, the magnet may be inserted to the body so that the body covers the entire surface of the magnet, or that the surface of a side of the magnet is exposed to the main body of the refrigerator while the other surfaces of the magnet are covered by the body.

The reason of limiting the magnet composition of the gasket for refrigerator door will now be described in detail.

Ferrite Powder: About 40 to 89.5 wt %

The ferrite powder is a key component to make the magnet have a magnetic property. Given this, the ferrite powder is actively added, and a lower limit of the addition to make the magnet have a magnetic property may be about 40 wt %. Components of the ferrite powder may be variously adjusted by taking into account the magnetic strength, but an upper limit of the addition of the ferrite power may be about 89.5 wt % taking into account contents of filler added to enhance insulation performance and a thermoplastic resin added by considering impact characteristics, which will be described later.

For example, the ferrite powder may include one or more of strontium ferrite oxide powder, barium ferrite oxide powder, and rare earth powder.

A Thermoplastic Resin: About 10 to 40 wt %

The thermoplastic resin is added for sufficient durability, e.g., impact characteristics of the magnet. Taking into this, about 10 wt % or more of the thermoplastic resin are added. However, when the thermoplastic resin exceeds about 40 wt %, the insulation property is likely to decline. Hence, in the disclosure, about 10 to 60 wt % of thermoplastic resin may be added.

For example, the thermoplastic resin may include one or more of polyethylene (PE), polypropylene (PP), polyvinyl chloride (PVC), acrylonitrile-butadien-styrene (ABS), polyamide (PA), and chlorinated polyethylene (CPE).

Filler: About 0.5 to 20 wt %

In the disclosure, the filler is an important component that reduces heat conductivity of the magnet for refrigerator door to improve the insulation property. The filler has heat conductivity of about 0.0001 to 0.2 W/m·K, which is lower than that of the ferrite powder or the thermoplastic resin, so the insulation property of the magnet may be improved.

In the disclosure, about 0.5 wt % or more of the filler is added to reduce the heat conductivity. However, when the filler is overly added, mechanical properties such as the impact characteristics of the magnet as well as durability decline, making it more likely that sufficient magnetic force may not be obtained. Given this, an upper limit of the filler added to the magnet may be limited to about 20 wt %.

The embodiment of the filler added to the magnet is the same as the previous embodiment of the filler added to the gasket body, so the detailed description thereof will not be repeated for convenience.

For example, the filler may be provided with one or more hollow particles with a diameter of about 1 to 100 μm or a porous material.

In the disclosure, to increase the insulation property of the filler, an insulation material with a heat conductivity of 0.03 W/m·K or less may fill in the air hole of hollow particle or the air hole of the porous material. To reduce the heat conductivity sufficiently, the insulation material may fill in the air hole at a filling ratio of about 10 to 60%. The higher the filling ratio, the better the insulating property, so a lower limit of the filling ratio may be about 20% or preferably, about 30%. However, in a case that the filling ratio is high, a mechanical property such as tensile strength is likely to decline, so an upper limit of the filling ratio may be desired to be about 50%.

Furthermore, to increase insulation property of the filler, the air hole of the hollow particle or the air hole of the porous material may be in a vacuum state. When the insulation material is in a liquid or solid state, the other areas than the area filled with the insulation material may be processed into the vacuum state by using e.g., a vacuum pump. In this case, heat conductivity may be reduced while saving manufacturing costs as compared with increasing the vacuum level.

In the disclosure, the porous material may be filled with an insulation material, or may have lots of air holes to process the inside into a vacuum state. For example, an air hole ratio of the porous material may be about 10 to 60%. The higher the air hole ratio, the better the insulating property, so a lower limit of the air hole ratio may be about 20% or preferably, about 30%. However, in a case that the air hole ratio of the porous material is high, a mechanical property such as tensile strength is likely to decline, so an upper limit of the air hole ratio may be desired to be about 50%.

In the disclosure, the magnet for refrigerator door may further include a binder and a pigment in addition to the aforementioned composition.

The binder is added to increase extrusion molding performance when the aforementioned composition is blended and then extruded. For example, the binder may be e.g., a chlorinated rubber.

The pigment is added to gain desired color on the magnet. For example, the pigment may be a titanium oxide, carbon black, violet, etc.

In the disclosure, the magnet for refrigerator door having the aforementioned composition has better insulation performance with a heat conductivity of about 1 W/m·K or less. Accordingly, cold air loss from the gasket may be reduced, and thus energy efficiency of the refrigerator may be improved.

Furthermore, the magnet of the gasket for refrigerator door may have a good insulation property as well as secure magnetic force of 70 g/50 mm or more, thereby having suitable magnetic force for the magnet of the gasket for refrigerator door.

In a third embodiment of the disclosure, a gasket for refrigerator door may include the gasket body according to the first embodiment of the disclosure, and the magnet of the gasket according to the second embodiment of the disclosure. For example, a gasket for refrigerator door may include a body arranged between a refrigerator door and a main body of the refrigerator, and a magnet inserted to the body to be attached/detached to/from the main body of the refrigerator. The body represented by wt % includes a thermoplastic resin: about 30 to 60%, a plasticizer: about 20 to 40%, and filler: about 3 to 30%, and the magnet represented by wt % includes ferrite powder: about 40 to 89.5%, a thermoplastic resin: about 10 to 40%, and a filler: about 0.5 to 20%.

The reason of limiting the composition of components of the gasket body in the third embodiment of the disclosure is the same as the reason of limiting the composition of components of the gasket body in the first embodiment of the disclosure, so the description thereof will not be repeated for convenience. Furthermore, the reason of limiting the composition of components of the magnet in the third embodiment of the disclosure is the same as the reason of limiting the composition of components of the magnet in the second embodiment of the disclosure, so the description will not be repeated for convenience.

Both the body and the magnet of the gasket for refrigerator door in the third embodiment of the disclosure have an enhanced insulation property, so the insulation performance of the gasket is better than that of the gasket according to the first or second embodiments of the disclosure.

In a fourth embodiment of the disclosure, a gasket for refrigerator door may include a body arranged between a refrigerator door and a main body of the refrigerator, and a magnet inserted to the body to be attached/detached to/from the main body of the refrigerator. The body represented by weight (wt) % includes a thermoplastic resin: about 30 to 60%, a plasticizer: about 20 to 40%, filler: about 3 to 30%, a surface modification agent: about 0.5 to 5%, and the other additives. The additives may include one or more of a stabilizer, a lubricant, a reinforcing agent, an antimicrobial agent, and a pigment.

The reason of limiting the body composition of the gasket for refrigerator door will now be described in detail.

The thermoplastic resin, the plasticizer, the filler, and the other additives included in the fourth embodiment of the disclosure are the same as in the first embodiment of the disclosure, so the description thereof will not be repeated.

A Surface Modification Agent: About 0.5 to 5%

A filler may be added to enhance insulation performance, as described above. When the addition of the filler is overly increased, however, it is likely to deteriorate the mechanical properties such as tensile strength, extension rate, hardness, etc., of the gasket body, and thus the durability of the gasket body. Specifically, when the addition of the filler is increased, an interface is created between the organic thermoplastic resin and the inorganic filler, and degradation of the mechanical properties such as tensile strength may increase due to interfacial debonding.

Hence, the gasket body in the fourth embodiment of the disclosure includes the surface modification agent to increase adhesive power between the organic thermoplastic resin and the inorganic filler, thereby enhancing the mechanical properties such as tensile strength. The surface modification agent may include at least one of a silane coupling agent, a titanate coupling agent, or a zirconate coupling agent.

For example, for the silane coupling agent, an alkoxy silyl (Si—OR) that alleviates degradation from the interfacial debonding is hydrolyzed by water or moisture into a silanol (Si—OH). The silanol and the inorganic surface are bonded by condensation reaction, thereby increasing bonding power, and another effector of the silane coupling agent, which is chemically bonded with an organic material is bonded or compatibilized with the organic material, thereby chemically bonding the inorganic material with the organic material.

With this principle, the surface modification agent may increase bonding power between the organic thermoplastic resin and the inorganic filler, thereby enhancing a mechanical property such as tensile strength even when the addition of the filler is increased.

To prevent degradation of the mechanical property due to the addition of the filler, about 0.5 wt % or more of the surface modification agent are added. When the amount of addition is overly low, the addition of the surface modification agent has no effect, so a lower limit of the surface modification agent is about 0.5 wt %. On the other hand, excessive addition of the surface modification agent may cause an increase in expense, over-processing, adhesion between subjects to be processed, difficulty in drying, etc., so an upper limit of the surface modification agent may be limited to about 5 wt %.

There are two methods of adding the surface modification agent: a method in which the surface modification agent is directly processed and added onto the inorganic surface and a method in which the surface modification agent is added simultaneously at a time of blending and mixed. Considering the manufacturing process and workability, the latter method of adding simultaneously at the time of blending may be desirable.

In this case, however, as the surface modification agent has a high molar mass, dispersibility of the surface modification agent may decline. To prevent the declination of dispersibility and facilitate uniform dispersion, increase in the amount of addition or increase in the blending time may be required. Hence, in the fourth embodiment of the disclosure, the molar mass (g/mol) of the surface modification agent is limited to about 100 to 500 g/mol so as to prevent declination of the dispersibility of the surface modification agent and facilitate efficient dispersion of the surface modification agent.

The gasket body for refrigerator door with the aforementioned composition has 100% improved tensile strength in average by adding the surface modification agent as compared to an occasion without addition of the surface modification agent although it depends on an amount of the content of the filler. For example, with addition of about 10 wt % of filler, the tensile strength of the gasket body is about 0.3 kgf/mm$^2$ without addition of the surface modification agent, and the gasket body has about 0.8 kgf/mm$^2$ of tensile strength with addition of a surface modification agent within (e.g., combining or bringing together) the content range and molar mass range according to the fourth embodiment of the disclosure. In both cases, heat conductivity of the gasket body has 0.15 W/m·K.

In other words, the gasket body in accordance with the fourth embodiment of the disclosure has 100% improved tensile strength in average and an improved insulation property of about 0.2 W/m·K or less. Accordingly, cold air loss from the gasket may be reduced, and thus energy efficiency of the refrigerator may be improved.

In a fifth embodiment of the disclosure, a gasket for refrigerator door may include a body arranged between a refrigerator door and a main body of the refrigerator, and a magnet inserted to the body to be attached/detached to/from the main body of the refrigerator. The body represented by wt % includes a thermoplastic resin: about 30 to 60%, a plasticizer: about 20 to 40%, filler: about 3 to 30%, and the other additives, and the thermoplastic resin may include polyvinyl chloride: about 15 to 30% and elastomer: about 15 to 30%. The additives may include one or more of a stabilizer, a lubricant, a reinforcing agent, an antimicrobial agent, and a pigment.

The reason of limiting the body composition of the gasket for refrigerator door will now be described in detail.

The plasticizer, the filler, and the other additives included in the fifth embodiment of the disclosure are the same as in the first embodiment of the disclosure, so the description thereof will not be repeated.

Polyvinyl chloride: about 15 to 30% and elastomer: about 15 to 30%

For the gasket for refrigerator to have durability against repetitive physical external force, recovering from the stress in an elastic area is required. In this regard, a related physical property of the polyvinyl chloride is not sufficient. Moreover, as the content of the filler for insulation performance increases, mechanical properties such as tensile strength, extension rate, hardness, etc., of the gasket decline.

In the fifth embodiment of the disclosure, a thermoplastic resin with a mixture of about 15 to 30% of polyvinyl chloride and about 15 to 30% of elastomer is used to alleviate declination of physical properties that may be caused when the polyvinyl chloride is used for the thermoplastic resin and when the content of the filler is increased. Such a proportion of the mixture of polyvinyl chloride and elastomer may enhance basic physical properties of the thermoplastic resin and avoid declination of the physical properties of the gasket.

The thermoplastic resin may include polyethylene (PE), polypropylene (PP), etc., in addition to the polyvinyl chloride, and the elastomer may include at least one of a styrene-butadiene rubber, a chloroprene rubber, silicon, thermoplastic polyurethane, thermoplastic vulcanizate, thermoplastic polyolefin or thermoplastic styrene.

The gasket body for refrigerator door having the composition in accordance with the fifth embodiment of the disclosure includes a thermoplastic resin mixed with elastomer, thereby having enhanced tensile strength. For example, with an addition of about 10 wt % of filler, when only the polyvinyl chloride is used for the thermoplastic resin without being mixed with the elastomer, tensile strength of the gasket body is about 0.3 kgf/mm$^2$. On the other hand, when the thermoplastic resin mixed with polyvinyl chloride and elastomer in a proportion of contents according to the fifth embodiment of the disclosure is used, tensile strength of the gasket body is about 0.9 kgf/mm$^2$. In both cases, heat conductivity of the gasket body has about 0.15 W/m·K.

In other words, the gasket body in accordance with the fifth embodiment of the disclosure has enhanced tensile strength and an improved insulation property of about 0.2 W/m·K or less. Accordingly, cold air loss from the gasket may be reduced, and thus energy efficiency of the refrigerator may be improved.

In a sixth embodiment of the disclosure, a gasket for refrigerator door may include a body arranged between a refrigerator door and a main body of the refrigerator, and a magnet inserted to the body to be attached/detached to/from the main body of the refrigerator. The body represented by wt % includes a thermoplastic resin: about 30 to 60%, a plasticizer: about 20 to 40%, filler: about 3 to 30%, a surface modification agent: about 0.5 to 5% and the other additives, and the thermoplastic resin may include polyvinyl chloride: about 15 to 30% and elastomer: about 15 to 30%. The additives may include one or more of a stabilizer, a lubricant, a reinforcing agent, an antimicrobial agent, and a pigment.

In the sixth embodiment of the disclosure, a thermoplastic resin mixed with the surface modification agent according to the fourth embodiment of the disclosure and the elastomer according to the fifth embodiment of the disclosure based on the first embodiment of the disclosure is provided. The thermoplastic resin mixed with the surface modification agent and the elastomer is the same as in the fourth or fifth embodiment of the disclosure, so the description thereof will not be repeated.

With the surface modification agent and the elastomer included, the gasket body has enhanced tensile strength and an improved insulation property of about 0.2 W/m·K or less. Accordingly, cold air loss from the gasket may be reduced, and thus energy efficiency of the refrigerator may be improved.

Magnets in the fourth, fifth, and sixth embodiments of the disclosure are the same as the magnet in the second embodiment of the disclosure, so the description thereof will not be repeated.

The disclosure may provide a refrigerator including the aforementioned gasket for refrigerator door. In the disclosure, the refrigerator may include a main body defining a storeroom, a door arranged to open or close the storeroom, and the gasket arranged between the main body and the door and having the structure as described above in the aforementioned embodiments of the disclosure.

The disclosure will now be described in more detail in the following embodiment of the disclosure. The following embodiment, however, is an illustrative example to describe the disclosure in more detail, and should not be construed as limiting the scope of the disclosure. The scope of the disclosure is defined by the claims and their equivalents.

Embodiment

A gasket body for refrigerator door is manufactured by mixing, compounding, extruding, and molding components of the gasket body with the composition as shown in the following table 1. Extrusion molding temperatures are about 140 to 200° C. Heat conductivity, tensile strength, extension rate, and hardness of the manufactured body are measured and shown in the following table 1.

TABLE 1

| section | thermoplastic resin (wt %) | plasticizer (wt %) | filler (wt %) | Heat conductivity (W/m · K) | mechanical property: tensile strength (kgf/mm$^2$) | extension rate (%) | hardness (Hs) |
|---|---|---|---|---|---|---|---|
| Inventive example 1 | 57 | 40 | 3 | 0.19 | 1.1 | 380 | 64 |
| Inventive example 2 | 52.5 | 40 | 7.5 | 0.16 | 1 | 360 | 67 |
| Inventive example 3 | 45 | 40 | 15 | 0.14 | 0.8 | 250 | 68 |
| Inventive example 4 | 42.5 | 40 | 17.5 | 0.12 | 0.7 | 210 | 68 |
| Inventive example 5 | 30 | 40 | 30 | 0.10 | 0.5 | 150 | 70 |

Referring to table 1, it is seen that heat conductivity meets about 0.2 W/m·K or less and thus insulation performance is improved within the range of composition of the gasket body for refrigerator door defined in the disclosure.

Furthermore, it is seen that the gasket body for refrigerator door has suitable mechanical properties by satisfying about 0.5 kgf/mm$^2$ or more of tensile strength, about 150% or more of extension rate, and about 60 to 70 Hs of hardness.

A magnet of the gasket for refrigerator door is manufactured by mixing, compounding, extruding, and molding magnet components of the gasket with the composition as shown in the following table 2. Heat conductivity and magnetic force of the manufactured magnet are measured and shown in the following table 2.

TABLE 2

| section | ferrite powder (wt %) | thermoplastic resin (wt %) | filler (wt %) | heat conductivity (W/m · K) | magnetic force (g/50 mm) |
|---|---|---|---|---|---|
| Inventive example 6 | 89.5 | 10 | 0.5 | 1 | 100 |
| Inventive example 7 | 87.5 | 10 | 2.5 | 0.95 | 85 |
| Inventive example 8 | 85 | 10 | 5 | 0.9 | 80 |
| Inventive example 9 | 82.5 | 10 | 7.5 | 0.85 | 75 |
| Inventive example 10 | 80 | 10 | 10 | 0.8 | 70 |

Referring to table 2, it is seen that heat conductivity meets about 1 W/m·K or less and thus insulation performance is improved within the range of composition of the magnet of the gasket for refrigerator door defined in the disclosure.

Furthermore, the magnet of the gasket for refrigerator door may have a good insulation property as well as secure magnetic force of 70 g/50 mm or more, thereby having a suitable magnetic force for the magnet of the gasket for refrigerator door.

According to an embodiment of the disclosure, a gasket for refrigerator door may be provided to enhance insulation performance by containing a filler.

Furthermore, a body of the gasket for refrigerator door having good insulation performance and suitable mechanical properties, such as tensile strength, extension rate, hardness, etc., may be provided.

Moreover, a magnet of the gasket for refrigerator door having good insulation performance and suitable magnetic power for the magnet of the refrigerator door may be provided.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A gasket for a refrigerator door, the gasket comprising, by weight % (wt %):
about 30 to 60% of thermoplastic resin;
about 20 to 40% of plasticizer;
about 3 to 30% of filler; and
about 0.5 to 5% of surface modification agent,
wherein the filler is provided with one or more hollow particles or a porous material, air holes of which have a diameter of about 1 to 100 μm, the filler having a heat conductivity of about 0.0001 to 0.2 W/m·K, and
wherein the surface modification agent has a molar mass of about 100 to 500 g/mol.

2. The gasket of claim 1, wherein the filler has a pressure intensity of about 500 to 20,000 PSI.

3. The gasket of claim 1, wherein the air holes of the one or more hollow particles or of the porous material are filled with an insulation material having a heat conductivity of about 0.03 W/m·K or less.

4. The gasket of claim 1, wherein the thermoplastic resin comprises, by wt %:
about 15 to 30% of polyvinyl chloride, and
about 15 to 30% of elastomer.

5. The gasket of claim 4, wherein the elastomer comprises at least one of a styrene-butadiene rubber, a chloroprene rubber, silicon, thermoplastic polyurethane, thermoplastic vulcanizate, thermoplastic polyolefin or thermoplastic styrene.

6. A gasket for a refrigerator door, the gasket comprising, by weight % (wt %):
about 30 to 60% of thermoplastic resin;
about 20 to 40% of plasticizer; and
about 3 to 30% of filler,
wherein the filler is provided with one or more hollow particles or a porous material, air holes of which have a diameter of about 1 to 100 μm, the filler having a heat conductivity of about 0.0001 to 0.2 W/m·K, and
wherein the thermoplastic resin comprises, by wt %:
about 15 to 30% of polyvinyl chloride, and
about 15 to 30% of elastomer.

7. The gasket of claim 6, wherein the elastomer comprises at least one of a styrene-butadiene rubber, a chloroprene rubber, silicon, thermoplastic polyurethane, thermoplastic vulcanizate, thermoplastic polyolefin or thermoplastic styrene.

8. The gasket of claim 6, further comprising, by wt %:
about 0.5 to 5% of surface modification agent.

9. The gasket of claim 8, wherein the surface modification agent has a molar mass of about 100 to 500 g/mol.

10. The gasket of claim 6, wherein the filler has pressure intensity of about 500 to 20,000 PSI.

11. The gasket of claim 6, wherein the air holes of the one or more hollow particles or of the porous material are filled with an insulation material having a heat conductivity of about 0.03 W/m·K or less.

12. A gasket for a refrigerator door, the gasket comprising:
a body configured to be arranged between a main body of a refrigerator and a refrigerator door; and
a magnet inserted to the body and arranged to be attached to or detached from the main body of the refrigerator,
wherein the body comprises, by weight % (wt %):
about 30 to 60% of thermoplastic resin,
about 20 to 40% of plasticizer,
about 3 to 30% of filler, and
one or more additional additives, and
wherein the filler is provided with one or more hollow particles or a porous material, air holes of which have a diameter of about 1 to 100 μm, the filler having a heat conductivity of about 0.0001 to 0.2 W/m·K.

13. The gasket of claim 12, wherein the air holes of the one or more hollow particles or of the porous material are filled with an insulation material having a heat conductivity of about 0.03 W/m·K or less.

14. The gasket of claim 13, wherein the insulation material is filled at a filling ratio of about 10 to 60%.

15. The gasket of claim 13, wherein the air holes of the one or more hollow particles or the porous material are provided in a vacuum state.

16. The gasket of claim 12, wherein the porous material has an air hole ratio of about 10 to 60%.

17. The gasket of claim 12, wherein the thermoplastic resin comprises one or more of polyvinyl chloride, polyethylene, polypropylene, thermoplastic elastomer, thermoplastic vulcanizate, and thermoplastic polyolefin.

18. The gasket of claim 12, wherein the body has an extrusion molding temperature of about 140 to 200° C.

19. The gasket of claim 12,
wherein the body has:
0.5 kgf/mm2 or more of tensile strength,
about 150% or more of extension rate, and
about 60 to 70 Hs of hardness, and
wherein the magnet comprises ferrite powder.

20. The gasket of claim 19, wherein the magnet comprises, by wt %, up to 89.5% of the ferrite powder.

21. The gasket of claim 19, wherein the ferrite powder comprises at least one of strontium ferrite oxide powder, barium ferrite oxide powder, or rare earth powder.

* * * * *